US011183121B2

(12) United States Patent
Chen et al.

(10) Patent No.: US 11,183,121 B2
(45) Date of Patent: Nov. 23, 2021

(54) VOLTAGE DROP COMPENSATION SYSTEM AND METHOD FOR POWER SUPPLY INSIDE DISPLAY PANEL

(71) Applicant: KunShan Go-Visionox Opto-Electronics Co., Ltd, Jiangsu (CN)

(72) Inventors: Xinquan Chen, Kunshan (CN); Chunsheng Xu, Kunshan (CN); Xiaobao Zhang, Kunshan (CN); Zheng Wang, Kunshan (CN)

(73) Assignee: KunShan Go-Visionox Opto-Electronics Co., Ltd, Kunshan (CN)

( * ) Notice: Subject to any disclaimer, the term of this patent is extended or adjusted under 35 U.S.C. 154(b) by 0 days.

(21) Appl. No.: 16/984,517

(22) Filed: Aug. 4, 2020

(65) Prior Publication Data

US 2020/0365087 A1 Nov. 19, 2020

Related U.S. Application Data

(63) Continuation of application No. PCT/CN2019/089642, filed on May 31, 2019.

(30) Foreign Application Priority Data

Nov. 29, 2018 (CN) ..... 201811447313.6

(51) Int. Cl.
*G09G 3/3258* (2016.01)

(52) U.S. Cl.
CPC ... *G09G 3/3258* (2013.01); *G09G 2320/0209* (2013.01); *G09G 2320/0233* (2013.01);
(Continued)

(58) Field of Classification Search
CPC .. G09G 3/3258; G09G 3/3233; G09G 3/3291; G09G 2320/0209;
(Continued)

(56) References Cited

U.S. PATENT DOCUMENTS 6,903,513 B2 * 6/2005 Choi ..... G09G 3/3208 315/169.2
2003/0098657 A1 5/2003 Suzuki
(Continued)

FOREIGN PATENT DOCUMENTS

CN 103198779 A 7/2013
CN 104464627 A 3/2015
(Continued)

OTHER PUBLICATIONS

International Search Report dated Sep. 3, 2019 in corresponding International Application No. PCT/CN2019/089642; 4 pages.
(Continued)

*Primary Examiner* — Tom V Sheng
(74) *Attorney, Agent, or Firm* — Maier & Maier, PLLC

(57) ABSTRACT

A voltage drop compensation system and method for a power supply inside a display panel, to solve technical problems of poor uniformity of screen brightness and high power consumption of the whole screen due to voltage drop of the power supply inside the display panel. The voltage drop compensation system includes a voltage detection circuit and a voltage compensation circuit, where the voltage detection circuit is configured to detect an ELVDD voltage of pixel units in each row; and the voltage compensation circuit is configured to compensate a data voltage of pixel units in each row based on a detected ELVDD voltage.

10 Claims, 3 Drawing Sheets

(52) U.S. Cl.
CPC ..... *G09G 2320/0673* (2013.01); *G09G 2330/028* (2013.01)

(58) Field of Classification Search
CPC ... G09G 2320/0233; G09G 2320/0673; G09G 2320/0693; G09G 2330/028
USPC ..... 345/690
See application file for complete search history.

(56) References Cited

U.S. PATENT DOCUMENTS

| | | | | |
|---|---|---|---|---|
| 2009/0225072 | A1* | 9/2009 | Mizukoshi | G09G 3/3233 345/214 |
| 2012/0086694 | A1* | 4/2012 | Tseng | G09G 3/3233 345/212 |
| 2014/0160093 | A1* | 6/2014 | Chaji | G09G 3/3258 345/204 |
| 2014/0300281 | A1* | 10/2014 | Chaji | G09G 3/3233 315/161 |
| 2014/0362124 | A1* | 12/2014 | Kim | G09G 3/3233 345/690 |
| 2015/0302817 | A1* | 10/2015 | Sun | G09G 3/20 345/89 |
| 2019/0340980 | A1* | 11/2019 | Yum | G09G 3/3233 |
| 2020/0143750 | A1* | 5/2020 | Gao | G09G 3/3291 |

FOREIGN PATENT DOCUMENTS

| | | | |
|---|---|---|---|
| CN | 105120133 | A | 12/2015 |
| CN | 106297665 | A | 1/2017 |
| CN | 108231016 | A | 6/2018 |
| CN | 108877676 | A | 11/2018 |
| CN | 109243374 | A | 1/2019 |
| KR | 20180059071 | A | 6/2018 |

OTHER PUBLICATIONS

Chinese Office Action dated Nov. 29, 2019 in corresponding Chinese Application No. 201811447313.6; 8 pages.

* cited by examiner

VOLTAGE DROP COMPENSATION SYSTEM AND METHOD FOR POWER SUPPLY INSIDE DISPLAY PANEL

CROSS-REFERENCE TO RELATED APPLICATIONS

This application is a continuation of International Application No. PCT/CN2019/089642, filed on May 31, 2019, which claims priority to Chinese Patent Application No. 201811447313.6, filed on Nov. 29, 2018, both of which are hereby incorporated by reference in their entireties.

TECHNICAL FIELD

The present disclosure relates to the field of display technologies and, in particular, to a voltage drop compensation system and method for a power supply inside a display panel.

BACKGROUND

Organic Light Emitting Diode (OLED for short), as a type of current-based light emitting device, is increasingly used in the field of high-performance display technologies, e.g., a flexible display panel, due to its characteristics such as self-illumination, fast response, wide visual angle and capacity of being manufactured on a flexible substrate. A voltage ELVDD (electroluminescent positive voltage power supply) outputted from a power supply voltage signal line is transmitted to pixel units in each row. However, as a display screen continues to increase in size, trace impedance of the power supply voltage signal line increases, resulting in that the voltage ELVDD outputted from the power supply voltage signal line has different degrees of voltage drop. As a result, currents flowing through different rows of pixel units are different, which makes the display panel have serious problems, such as poor uniformity of brightness, large power consumption of the whole screen, cross talk effect (that is, a phenomenon of mutual influence between display areas in matrix display, for example, with respect to displaying, a row or a column in a matrix will affect other rows or columns in the matrix).

In the prior art, brightness uniformity of the display panel is improved mainly by improving manufacturing processes or materials of the display panel, and the cross talk effect is reduced by optimizing driving ability of the driving chip.

However, the improvement in the manufacturing processes or materials is very difficult, and the improvement in the brightness uniformity of the display panel is not good in terms of effect. With regard to the improvement of the cross talk effect by optimizing the driving ability of the driving chip, such improvement has a poor effect and it is easy to have a negative impact on display of the display panel.

SUMMARY

In view of the above defects, the present disclosure provides a voltage drop compensation system and method for a power supply inside a display panel, to solve technical problems about poor uniformity of screen brightness and high power consumption of the whole screen due to voltage drop of the power supply inside the display panel.

In the first aspect, an embodiment of the present disclosure provides a voltage drop compensation system for a power supply inside a display panel, including a voltage detection circuit and a voltage compensation circuit, where the voltage detection circuit is electrically connected with pixel units in each row of the display panel through an ELVDD signal line, and is configured to detect an ELVDD voltage of pixel units in each row; and the voltage compensation circuit is configured to compensate a data voltage of pixel units in each row based on the detected ELVDD voltage to obtain an equal absolute value of a voltage difference between the data voltage and a corresponding ELVDD voltage of pixel units in each row.

In an optional implementation, the ELVDD signal line is electrically connected with m rows of pixel units of the display panel respectively, where the m rows of pixel units of the display panel are divided into n segmented areas along an extension direction of the ELVDD signal line; at least one of the n segmented areas is provided with a voltage detection point that is electrically connected with the voltage detection circuit, and m is a total number of the rows of pixel units of the display panel, where $m \geq 1$, and $n \geq 1$.

In an optional implementation, the voltage detection circuit is configured to: obtain a real-time voltage of pixel units in the k-th row of the display panel, denoted as ELVDD(k), where $$k = \frac{m}{n} \times t,$$

$1 \leq n \leq m$, $1 \leq t \leq n$, and t is a serial number of the voltage detection point; and denote a detected real-time voltage of pixel units in 1-st row as ELVDD(1), and then calculate a real-time voltage of pixel units in any remaining row of the display panel by using a linear interpolation method, where the calculation equation is as follows:

$$ELVDD(i) = \frac{ELVDD\left(\frac{m}{n} \times t\right) - ELVDD\left(\frac{m}{n} \times (t-1)\right)}{\frac{m}{n}} \times \left(1 - \frac{m \times (t-1)}{n}\right) + ELVDD\left(\frac{m}{n} \times (t-1)\right)$$

where ELVDD(i) is a real-time voltage of pixel units in i-th row, i=2, 3, . . . , m.

In an optional implementation, the voltage compensation circuit is configured to:

obtain a real-time voltage ELVDD(1) of pixel units in the 1-st row of the display panel;

obtain an offset between the real-time voltage ELVDD(1) and a preset voltage; and adjust a voltage offset of a Gamma power supply based on the offset to remain a voltage difference between the real-time voltage ELVDD(1) and a peak voltage VGMP outputted from the Gamma power supply unchanged, and remain a voltage difference between the peak voltage VGMP and a valley voltage VGSP outputted from the Gamma power supply unchanged, where the Gamma power supply is configured to provide a compensation voltage for each pixel unit.

In an optional implementation, the voltage compensation circuit is further configured to:

obtain an absolute value of a voltage difference between the real-time voltage of pixel units in the i-th row and the detected real-time voltage of the pixel units in the 1-st row of the display panel, denoted as |ELVDD(i)−ELVDD(1)|;

and based on the value of |ELVDD(i)−ELVDD(1)|, shift a data voltage Vdata(i) of the pixel units in the i-th row at an equal ratio to make |ELVDD(i)−Vdata(i)| be a same constant.

In the second aspect, the present disclosure provides a voltage drop compensation method for a power supply inside a display panel, applied to a voltage drop compensation system for the power supply inside the display panel, with the system including a voltage detection circuit and a voltage compensation circuit, where the voltage detection circuit is electrically connected with pixel units in each row of the display panel through an ELVDD signal line, and the method includes:

detecting an ELVDD voltage of the pixel units in each row by the voltage detection circuit; and based on a detected ELVDD voltage, compensating a data voltage of the pixel units in each row by the voltage compensation circuit to obtain an equal absolute value of a voltage difference between the data voltage and a corresponding ELVDD voltage of the pixel units in each row.

In an optional implementation, the ELVDD signal line is electrically connected with m rows of pixel units of the display panel respectively; the m rows of pixel units of the display panel are divided into n segmented areas along an extension direction of the ELVDD signal line; at least one of the n segmented areas is provided with a voltage detection point that is electrically connected with the voltage detection circuit; and m is a total number of the rows of pixel units of the display panel, where m≥1, and n≥1.

In an optional implementation, the detecting the ELVDD voltage of the pixel units in each row includes:

obtaining a real-time voltage of pixel units in k-th row of the display panel, denoted as ELVDD(k), where $$k = \frac{m}{n} \times t,$$

1≤n≤m, 1≤t≤n, and t is a serial number of the voltage detection point; and denoting a detected real-time voltage of pixel units in 1-st row as ELVDD(1), and then calculating a real-time voltage of pixel units in any remaining row of the display panel by using a linear interpolation method, where the calculation equation is as follows:

$$ELVDD(i) = \frac{ELVDD\left(\frac{m}{n} \times t\right) - ELVDD\left(\frac{m}{n} \times (t-1)\right)}{\frac{m}{n}} \times \left(1 - \frac{m \times (t-1)}{n}\right) + ELVDD\left(\frac{m}{n} \times (t-1)\right)$$

where ELVDD(i) is a real-time voltage of pixel units in i-th row, where i=2, 3, . . . , m.

In an optional implementation, the method further includes:

obtaining a real-time voltage ELVDD(1) of the pixel units in the 1-st row of the display panel by the voltage compensation circuit;

obtaining an offset between the real-time voltage ELVDD (1) and a preset voltage by the voltage compensation circuit; and based on the offset, adjusting a voltage offset of a Gamma power supply by the voltage compensation circuit to remain a voltage difference between the real-time voltage ELVDD (1) and a peak voltage VGMP outputted from the Gamma power supply unchanged, and remain a voltage difference between the peak voltage VGMP and a valley voltage VGSP outputted from the Gamma power supply unchanged, where the Gamma power supply is configured to provide a compensation voltage for each pixel unit.

In an optional implementation, the compensating the data voltage of the pixel units in each row based on the detected ELVDD voltage includes:

obtaining an absolute value of a voltage difference between the real-time voltage of pixel units in the i-th row and the detected real-time voltage of the pixel units in the 1-st row of the display panel, denoted as |ELVDD(i)−ELVDD(1)|; and based on the value of |ELVDD(i)−ELVDD(1)|, shifting a data voltage Vdata(i) of the pixel units in the i-th row at an equal ratio to make |ELVDD(i)−Vdata(i)| be a same constant.

The present disclosure provides a voltage drop compensation system and method for a power supply inside a display panel, the voltage drop compensation system including a voltage detection circuit and a voltage compensation circuit, where the voltage detection circuit is electrically connected with pixel units in each row of the display panel through an ELVDD signal line, and is configured to detect an ELVDD voltage of the pixel units in each row; and the voltage compensation circuit is configured to compensate a data voltage of the pixel units in each row based on a detected ELVDD voltage to obtain an equal absolute value of a voltage difference between the data voltage and a corresponding ELVDD voltage of the pixel units in each row. Because a real-time voltage of the pixel units in each row may be obtained by the voltage detection circuit in real time, a data voltage of the pixel units in each row may be compensated respectively by the voltage compensation circuit based on the real-time voltage of the pixel units in each row. By controlling the absolute value of a voltage difference between the data voltage and a corresponding ELVDD voltage of the pixel units in each row to be equal, under a condition of high refresh frequency, the uniformity and the stability of the brightness of the display panel can be improved and the cross talk effect can be effectively weakened so as to reduce the power consumption of the whole screen.

DETAILED DESCRIPTION OF EMBODIMENTS

In order to make objectives, technical solutions and advantages of the embodiments of the present disclosure clearer, the technical solutions in the embodiments of the present disclosure will be described clearly and comprehensively in combination with the drawings in the embodiments of the present disclosure. Obviously, the described embodiments are parts of the embodiments of the present disclosure, rather than all of them.

Based on the embodiments in the present disclosure, all other embodiments obtained by those of ordinary skill in the art without creative effort should fall into the protection scope of the present disclosure. The following embodiments and the features therein may be combined with one another without conflict.

Figure 1:
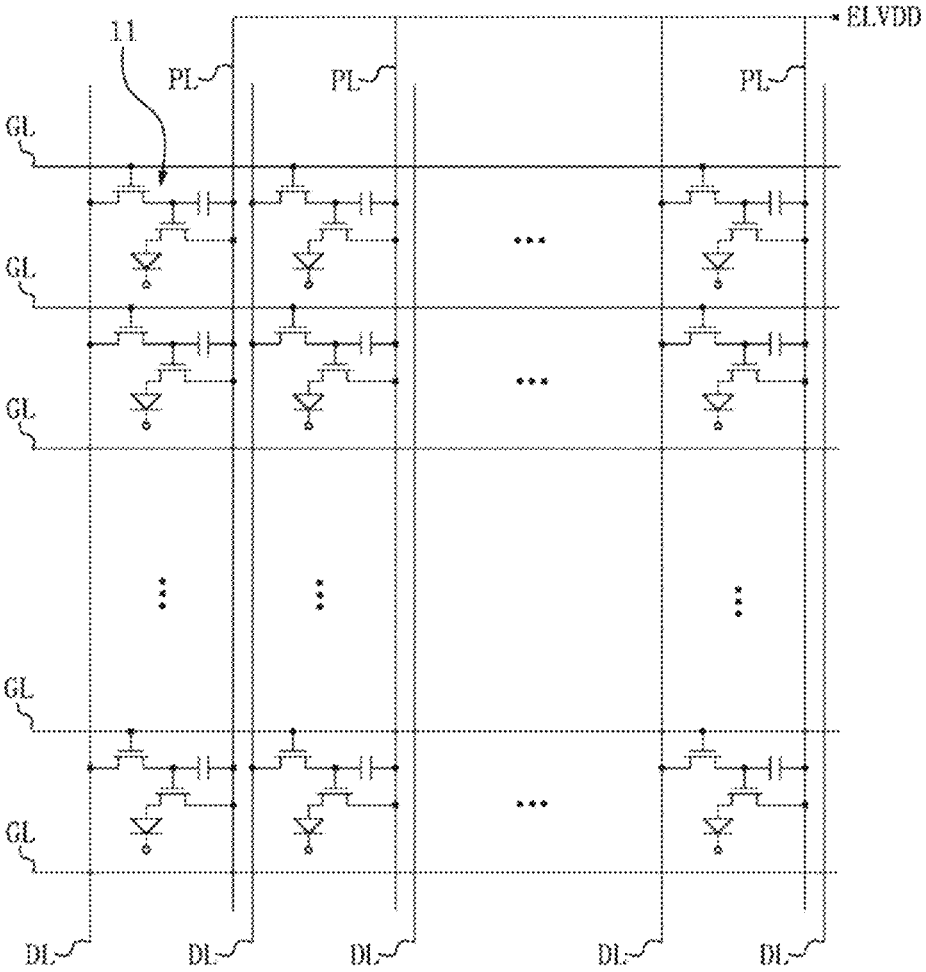
FIG. 1 is a structural diagram of a display panel in the prior art.

FIG. 1 is a structural diagram of a display panel in the prior art. As shown in FIG. 1, the display panel includes a plurality of scan lines GL, a plurality of data lines DL and a plurality of pixel units (not shown in the figure) arranged in a matrix with a plurality of rows and columns Each pixel unit is provided with a pixel driving circuit 11, which for example, has the most common 2T1C structure (including a switching thin film transistor and a driving thin film transistor, a storage capacitor and an organic light emitting diode). Each pixel driving circuit 11 is driven by one scan line GL and one data line DL. The display panel further includes a power chip (not shown in the figure) and a plurality of power supply voltage signal lines PL connected with the power chip. The power chip is configured to provide a power supply voltage ELVDD, and the power supply voltage signal line PL is configured to transmit the power supply voltage ELVDD to the pixel driving circuit 11 within each pixel unit.

As shown in FIG. 1, assuming that the display panel has X rows and Y columns of pixel units, the pixel driving circuits 11 for each column of pixel units output a power supply voltage ELVDD through one power supply voltage signal line PL, that is, there are totally Y power supply voltage signal lines PL, and X pixel driving circuits 11 are connected in series sequentially on each power supply voltage signal line PL. In an ideal case where the impedance of the power supply voltage signal line PL for transmitting the power supply voltage ELVDD is ignored, the current flowing through each pixel driving circuit 11 is identical. However, in reality, because it is inevitable that the power supply voltage signal line PL has certain trace impedance, and with the increase of the screen size and resolution of the display panel, the power supply voltage signal line PL becomes longer, and the impedance in turn becomes higher, the power supply voltage ELVDD will generate a voltage drop (IR Drop) on the power supply voltage signal line PL. In the display panel, a power supply voltage at an area closing to the power chip is higher than that far away from the power chip, so that the currents flowing through the pixel drive circuits 11 at different positions are different, resulting in the problem about the poor uniformity and low stability of the brightness of the display panel; especially the cross talk effect is serious under a condition of high refresh frequency.

In view of the above problems, the present disclosure is intended to provide a pixel arrangement structure for the display panel as well as a display device, so as to improve the pixel opening rate of an organic light emitting diode display panel.

Figure 2:
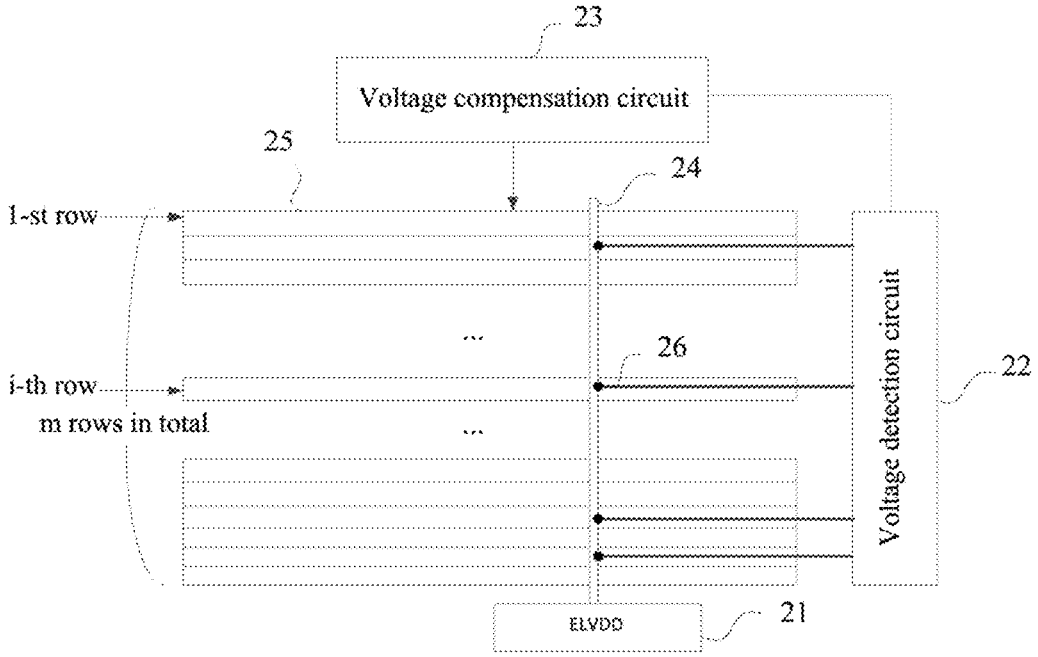
FIG. 2 is a structural diagram of a voltage drop compensation system for a power supply inside a display panel according to a first embodiment of the present disclosure.

FIG. 2 is a structural diagram of a voltage drop compensation system for a power supply inside a display panel according to a first embodiment of the present disclosure. As shown in FIG. 2, the voltage drop compensation system according to this embodiment includes a voltage detection circuit 22 and a voltage compensation circuit 23, where the voltage detection circuit 22 is electrically connected with pixel units 25 in each row of the display panel through an ELVDD signal line 24, and is configured to detect a ELVDD voltage of the pixel units 25 in each row; the voltage compensation circuit 23 is configured to compensate a data voltage of the pixel units 25 in each row based on a detected ELVDD voltage to obtain an equal absolute value of a voltage difference between the data voltage and a corresponding ELVDD voltage of pixel units 25 in each row. The voltage detection circuit 22 is electrically connected with a voltage detection point 26 on the ELVDD signal line 24, and the power supply voltage ELVDD 21 provided by the power chip transmits electric energy to the ELVDD signal line 24.

In an optional implementation, referring to FIG. 2, assuming that the ELVDD signal line 24 is electrically connected with m rows of pixel units of the display panel respectively; where the m rows of pixel units of the display panel are divided into n segmented areas along an extension direction of the ELVDD signal line, at least one of the n segmented areas is provided with a voltage detection point 26 that is electrically connected with the voltage detection circuit 22, and m is a total number of the rows of pixel units of the display panel.

In this embodiment, the voltage detection circuit 22 may detect a real-time voltage at each voltage detection point 26 in real time, where the real-time voltage at the voltage detection point 26 is a real-time voltage of pixel units in a row where the voltage detection point 26 is located. For the convenience of description, a real-time voltage of pixel units in k-th row of the display panel is denoted as ELVDD(k), where $$k = \frac{m}{n} \times t,$$

$1 \le n \le m$, $1 \le t \le n$, and t is a serial number of the voltage detection point.

In an optional implementation, a real-time voltage of pixel units in the 1-st row of the display panel may be detected by the voltage detection circuit 22, and the detected real-time voltage of the pixel units in the 1-st row may be denoted as ELVDD(1), then a real-time voltage of pixel units in any remaining row of the display panel may be calculated by using a linear interpolation method, where the calculation equation is as follows:

$$ELVDD(i) = \frac{ELVDD\left(\frac{m}{n} \times t\right) - ELVDD\left(\frac{m}{n} \times (t-1)\right)}{\frac{m}{n}} \times \left(1 - \frac{m \times (t-1)}{n}\right) + ELVDD\left(\frac{m}{n} \times (t-1)\right)$$

where ELVDD(i) is a real-time voltage of pixel units in i-th row, i=1, 2, 3, . . . , m.

In this embodiment, after the real-time voltage of the pixel units in the 1-st row is known, based on the real-time voltage measured by a limited number of voltage detection points 26, a real-time voltage of pixel units in any remaining row may be calculated by using a linear interpolation method. Such a manner may reduce the complexity of the voltage detection circuit 22, reduce the number of voltage detection points, and the real-time voltage of pixel units in any remaining row may be quickly and accurately obtained.

In an optional implementation, an absolute value of a voltage difference between the real-time voltage of pixel units in the i-th row and the detected real-time voltage of the pixel units in the 1-st row of the display panel may be obtained by the voltage compensation circuit 23, and the absolute value is denoted as |ELVDD(i)−ELVDD(1)|; then, based on the value of |ELVDD(i)−ELVDD(1)|, a data voltage Vdata(i) of the pixel units in the i-th row may be shifted at an equal ratio to make |ELVDD(i)−Vdata(i)| be a same constant.

In this embodiment, because the difference between the real-time voltage and the data voltage of pixel units in any row of the display panel is a same constant, the coupling frequency between the ELVDD voltage and the data voltage may be reduced, and the stability of the brightness of the display panel can be improved. Because the absolute values of the voltage differences between the real-time voltage of pixel units in the 1-st row and real-time voltages of pixel units in any row of the display panel (except the pixel units in the 1-st row) are equal, the uniformity of the brightness of the display panel may be improved and the display effect of the display panel may be effectively improved.

In this embodiment, the ELVDD voltage of pixel units in each row is detected by arrangement of the voltage detection circuit electrically connected with the ELVDD signal line; the data voltage of pixel units in each row is compensated by the voltage compensation circuit based on the detected ELVDD voltage, so as to obtain an equal absolute value of a voltage difference between the data voltage and a corresponding ELVDD voltage of the pixel units in each row.

Because the real-time voltage of pixel units in each row may be obtained by the voltage detection circuit in real time, the data voltage of the pixel units in each row may be compensated respectively by the voltage compensation circuit based on the real-time voltage of the pixel units in each row. By controlling the absolute value of a voltage difference between the data voltage and a corresponding ELVDD voltage of the pixel units in each row to be equal, under a condition of high refresh frequency, the uniformity and the stability of the brightness of the display panel can be improved and the cross talk effect can be effectively weakened so as to reduce the power consumption of the whole screen.

Figure 3:
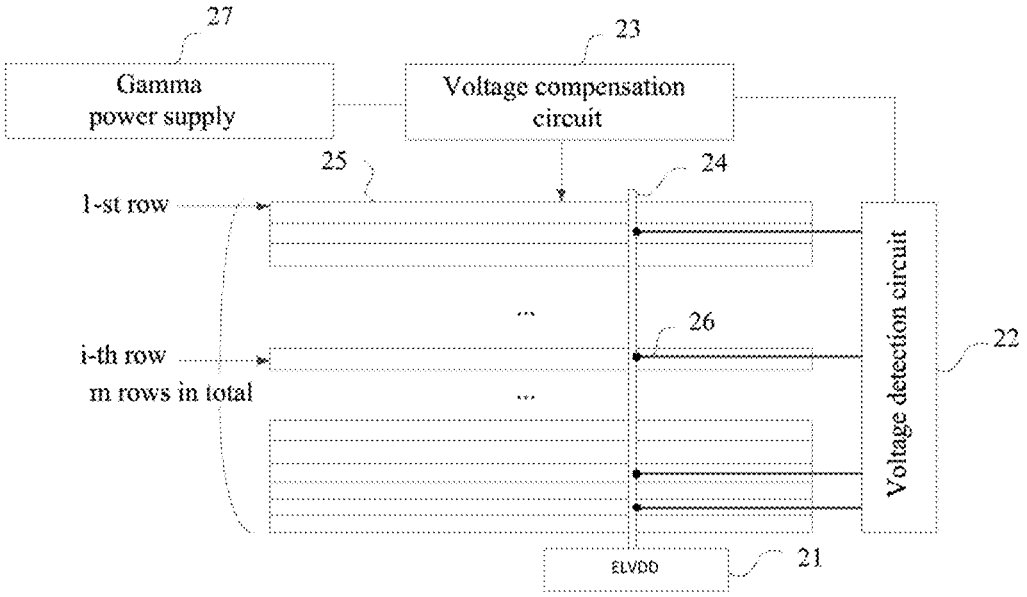
FIG. 3 is a structural diagram of a voltage drop compensation system for a power supply inside a display panel according to a second embodiment of the present disclosure.

FIG. 3 is a structural diagram of a voltage drop compensation system for a power supply inside a display panel according to a second embodiment of the present disclosure. As shown in FIG. 3, the voltage drop compensation system according to this embodiment includes a voltage detection circuit 22 and a voltage compensation circuit 23, where the voltage detection circuit 22 is electrically connected with a voltage detection point 26 on an ELVDD signal line 24, to which the power supply voltage ELVDD 21 provided by the power chip transmits electric energy; the voltage detection circuit 22 is electrically connected with pixel units 25 in each row of the display panel through the ELVDD signal line 24, and is configured to detect a ELVDD voltage of the pixel units 25 in each row; the voltage compensation circuit 23 is configured to compensate a data voltage of the pixel units 25 in each row based on a detected ELVDD voltage, so as to obtain an equal absolute value of a voltage difference between the data voltage and the corresponding ELVDD voltage of the pixel units 25 in each row. Among them, the voltage compensation circuit 23 is also electrically connected with a Gamma power supply 27, and is configured to automatically compensate a voltage outputted from the Gamma power supply.

In an optional implementation, the voltage compensation circuit 23 obtains a real-time voltage ELVDD(1) of pixel units in the 1-st row of the display panel, and then obtains an offset between the real-time voltage ELVDD(1) and a preset voltage, and finally based on the above offset, adjusts a voltage offset of the Gamma power supply 27, so as to remain a voltage difference between the real-time voltage ELVDD(1) and a peak voltage VGMP outputted from the Gamma power supply unchanged, and remain a voltage difference between the peak voltage VGMP and a valley voltage VGSP outputted from the Gamma power supply unchanged, where the Gamma power supply is configured to provide a compensation voltage for each pixel unit.

In this embodiment, a voltage offset of the Gamma power supply is adjusted to remain both a voltage difference between the voltage ELVDD and a peak voltage VGMP outputted from the Gamma power supply and a voltage difference between the peak voltage VGMP and a valley voltage VGSP unchanged, so as to achieve self-adaptive compensation for data voltages of pixel units in each row.

In this embodiment, the ELVDD voltage of pixel units in each row is detected by arrangement of the voltage detection circuit electrically connected with the ELVDD signal line; the data voltage of the pixel units in each row is compensated by the voltage compensation circuit based on a detected ELVDD voltage, so as to obtain an equal absolute value of a voltage difference between the data voltage and a corresponding ELVDD voltage of the pixel units in each row.

Because the real-time voltage of pixel units in each row may be obtained by the voltage detection circuit in real time, the data voltage of pixel units in each row may be compensated respectively by the voltage compensation circuit based on the real-time voltage of the pixel units in each row. By controlling the absolute value of a voltage difference between the data voltage and a corresponding ELVDD voltage of pixel units in each row to be equal, under a condition of high refresh frequency, the uniformity and the stability of the brightness of the display panel can be improved and the cross talk effect can be effectively weakened so as to reduce the power consumption of the whole screen.

Figure 4:
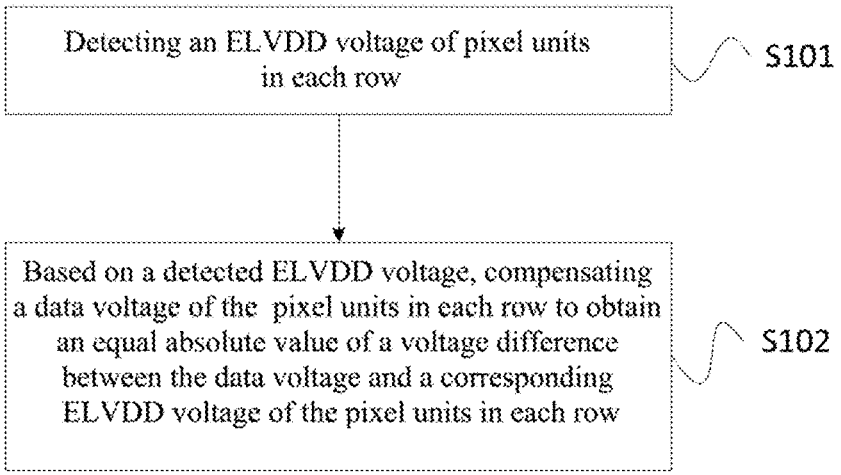
FIG. 4 is a flowchart of a voltage drop compensation method for a power supply inside a display panel according to a third embodiment of the present disclosure.

FIG. 4 is a flowchart of a voltage drop compensation method for a power supply inside a display panel according to a third embodiment of the present disclosure. As shown in FIG. 4, the method according to this embodiment may include:

S101: detecting an ELVDD voltage of pixel units in each row.

Referring to FIG. 1, the method in this embodiment is applied to a voltage drop compensation system for the power supply inside the display panel, including a voltage detection circuit and a voltage compensation circuit, where the voltage detection circuit is electrically connected with pixel units in each row of the display panel through an ELVDD signal line, and is configured to detect an ELVDD voltage of the pixel units in each row. The ELVDD signal line is electrically connected with m rows of pixel units of the display panel respectively; where the m rows of pixel units of the display panel are divided into n segmented areas along an extension direction of the ELVDD signal line, at least one of the n segmented areas is provided with a voltage detection point that is electrically connected with the voltage detection circuit, and m is a total number of the rows of pixel units of the display panel.

Optionally, a real-time voltage of pixel units in k-th row of the display panel may be obtained and denoted as ELVDD(k), where $$k = \frac{m}{n} \times t,$$

1≤n≤m, 1≤t≤n, and t is a serial number of the voltage detection point;

a detected real-time voltage of pixel units in the 1-st row may be denoted as ELVDD(1), and then a real-time voltage of pixel units in any remaining row of the display panel may be calculated by using a linear interpolation method, where the calculation equation is as follows:

$$ELVDD(i) = \frac{ELVDD\left(\frac{m}{n} \times t\right) - ELVDD\left(\frac{m}{n} \times (t-1)\right)}{\frac{m}{n}} \times \left(1 - \frac{m \times (t-1)}{n}\right) + ELVDD\left(\frac{m}{n} \times (t-1)\right)$$

where ELVDD(i) is a real-time voltage of the pixel units in the i-th row, i=2, 3, . . . , m.

S102: Compensating a data voltage of the pixel units in each row based on a detected ELVDD voltage to obtain an equal absolute value of a voltage difference between the data voltage and a corresponding ELVDD voltage of the pixel units in each row.

This step is realized by the voltage compensation circuit. In this embodiment, an absolute value of a voltage difference between the real-time voltage of pixel units in the i-th row and the detected real-time voltage of pixel units in the 1-st row of the display panel may be obtained and denoted as |ELVDD(i)−ELVDD(1)|; based on the value of |ELVDD(i)−ELVDD(1)|, a data voltage Vdata(i) of pixel units in the i-th row may be shifted at an equal ratio to make |ELVDD(i)−Vdata(i)| to be a same constant.

Optionally, the method in this embodiment may also include the following steps of:

obtaining a real-time voltage ELVDD(1) of pixel units in the 1-st row of the display panel;

obtaining an offset between the real-time voltage ELVDD (1) and a preset voltage; and based on the offset, adjusting a voltage offset of a Gamma power supply, so as to remain a voltage difference between the real-time voltage ELVDD(1) and a peak voltage VGMP outputted from the Gamma power supply unchanged, and remain a voltage difference between the peak voltage VGMP and a valley voltage VGSP outputted from the Gamma power supply unchanged, where the Gamma power supply is configured to provide a compensation voltage for each pixel unit.

The above steps are realized by the voltage compensation circuit.

The method in this embodiment can be applied to the voltage drop compensation systems for the power supply inside the display panel as shown in FIG. 2 and FIG. 3. Their specific implementation processes and technical principles are described in relevant contents about FIG. 2 and FIG. 3, which will not be repeated herein again.

In the present disclosure, unless otherwise specified, the terms "installation", "connection", "couple", "fixation" and other terms shall be understood in a broad sense, for example, these terms may be fixed connection, detachable connection, integral forming, mechanical connection, electrical connection or communication with one another, direct connection, indirect connection through an intermediate media, internal connection between two components, or interaction relationship between two components. For those of ordinary skill in the art, the specific meanings of the above terms in the present disclosure can be understood according to the specific situation.

Finally, it should be noted that the respective embodiments above are only used to explain the technical solution of the present disclosure, not to limit it. Although the present disclosure has been described in detail with reference to the respective embodiments above, those of ordinary skill in the art should understand that they may still modify the technical solution denoted in the respective embodiments above, or equivalently replace some or all of their technical features; and these modifications or replacements do not make the nature of the respective technical solution depart from the scope of the technical solutions of the embodiments of the present disclosure.

What is claimed is:

1. A voltage drop compensation system for a power supply inside a display panel, comprising:

a voltage detection circuit electrically connected with pixel units in each row of the display panel through an ELVDD signal line and configured to detect an ELVDD voltage of the pixel units in each row; and a voltage compensation circuit configured to compensate a data voltage of the pixel units in each row based on a detected ELVDD voltage, to obtain an equal absolute value of a voltage difference between the data voltage and the corresponding ELVDD voltage of the pixel units in each row;

wherein the ELVDD signal line is electrically connected with m rows of pixel units of the display panel respectively, the m rows of pixel units of the display panel are divided into n segmented areas along an extension direction of the ELVDD signal line, at least one of the n segmented areas is provided with a voltage detection point that is electrically connected with the voltage detection circuit, and m is a total number of the rows of pixel units of the display panel, wherein m≥1, and n≥1;

wherein the voltage detection circuit is configured to:

obtain a real-time voltage of pixel units in k-th row of the display panel, denoted as ELVDD(k), wherein $$k = \frac{m}{n} \times t,$$

1≤n≤m, 1≤t≤n, and t is a serial number of the voltage detection point; and denote a detected real-time voltage of pixel units in 1-st row as ELVDD(1), and then calculate a real-time voltage of pixel units in any remaining row of the display panel by using a linear interpolation method, wherein the calculation equation is as follows:

$$ELVDD(i) = \frac{ELVDD\left(\frac{m}{n} \times t\right) - ELVDD\left(\frac{m}{n} \times (t-1)\right)}{\frac{m}{n}} \times \left(1 - \frac{m \times (t-1)}{n}\right) + ELVDD\left(\frac{m}{n} \times (t-1)\right)$$

wherein ELVDD(i) is a real-time voltage of pixel units in i-th row, i=2, 3, . . . , m.

2. The system according to claim 1, wherein the voltage compensation circuit is configured to:

obtain a real-time voltage ELVDD(1) of pixel units in 1st row of the display panel; and obtain an offset between the real-time voltage ELVDD(1) and a preset data voltage.

3. The system according to claim 2, wherein the voltage compensation circuit is configured to adjust a voltage offset of a Gamma power supply based on the offset, to remain a voltage difference between the real-time voltage ELVDD(1) and a peak voltage VGMP outputted from the Gamma power supply unchanged, and remain a voltage difference between the peak voltage VGMP and a valley voltage VGSP outputted from the Gamma power supply unchanged, wherein the Gamma power supply is configured to provide a compensation voltage for each pixel unit.

4. The system according to claim 1, wherein the voltage compensation circuit is further configured to:

obtain an absolute value of a voltage difference between the real-time voltage of the pixel units in the i-th row and the detected real-time voltage of the pixel units in the 1st row of the display panel, denoted as |ELVDD(i)−ELVDD(1)|; and based on the value of |ELVDD(i)−ELVDD(1)|, shift a data voltage Vdata(i) of the pixel units in the i-th row at an equal ratio to make |ELVDD(i)−Vdata(i)| be a same constant.

5. A voltage drop compensation method for a power supply inside a display panel, applied to a voltage drop compensation system for the power supply inside the display panel, with the system comprising a voltage detection circuit and a voltage compensation circuit, wherein the voltage detection circuit is electrically connected with pixel units in each row of the display panel through an ELVDD signal line, and the method comprises:

detecting an ELVDD voltage of the pixel units in each row by the voltage detection circuit; and based on the ELVDD voltage, compensating a data voltage of the pixel units in each row by the voltage compensation circuit, to obtain an equal absolute value of a voltage difference between the data voltage and the corresponding ELVDD voltage of the pixel units in each row;

wherein the ELVDD signal line is electrically connected with m rows of pixel units of the display panel respectively, the m rows of pixel units of the display panel are divided into n segmented areas along an extension direction of the ELVDD signal line, at least one of the n segmented areas is provided with a voltage detection point that is electrically connected with the voltage detection circuit, and m is a total number of the rows of pixel units of the display panel, wherein m≤1, and n≤1;

wherein the detecting of the ELVDD voltage of the pixel units in each row comprises:

obtaining a real-time voltage of pixel units in k-th row of the display panel, denoted as ELVDD(k), wherein $$k = \frac{m}{n} \times t,$$

1≤n≤m, 1≤t≤n, and t is a serial number of the voltage detection point; and denoting a detected real-time voltage of pixel units in 1st row as ELVDD(1), and then calculating a real-time voltage of pixel units in any remaining row of the display panel by using a linear interpolation method, wherein the calculation equation is as follows:

$$ELVDD(i) = \frac{ELVDD\left(\frac{m}{n} \times t\right) - ELVDD\left(\frac{m}{n} \times (t-1)\right)}{\frac{m}{n}} \times \left(1 - \frac{m \times (t-1)}{n}\right) + ELVDD\left(\frac{m}{n} \times (t-1)\right)$$

wherein ELVDD(i) is a real-time voltage of pixel units in i-th row, i=2, 3, . . . , m.

6. The method according to claim 5, further comprising obtaining a real-time voltage ELVDD(1) of pixel units in the 1-st row of the display panel by the voltage compensation circuit; and obtaining an offset between the real-time voltage ELVDD(1) and a preset data voltage by the voltage compensation circuit.

7. The method according to claim 6, further comprising:

based on the offset, adjusting a voltage offset of a Gamma power supply by the voltage compensation circuit, to remain a voltage difference between the real-time voltage ELVDD(1) and a peak voltage VGMP outputted from the Gamma power supply unchanged, and remain a voltage difference between the peak voltage VGMP and a valley voltage VGSP outputted from the Gamma power supply unchanged, wherein the Gamma power supply is configured to provide a compensation voltage for each pixel unit.

8. The method according to claim 5, wherein the compensating the data voltage of the pixel units in each row based on the detected ELVDD voltage comprises:

obtaining an absolute value of a voltage difference between the real-time voltage of the pixel units in the i-th row and the detected real-time voltage of the pixel units in the 1st row of the display panel, denoted as |ELVDD(i)−ELVDD(1)|; and based on the value of |ELVDD(i)−ELVDD(1)|, shifting a data voltage Vdata(i) of the pixel units in the i-th row at an equal ratio to make |ELVDD(i)−Vdata(i)| be a same constant.

9. A voltage drop compensation system for a power supply inside a display panel, comprising:

a voltage detection circuit electrically connected with pixel units in each row of the display panel through an ELVDD signal line and configured to detect an ELVDD voltage of the pixel units in each row; and a voltage compensation circuit configured to compensate a data voltage of the pixel units in each row based on a detected ELVDD voltage, to obtain an equal absolute value of a voltage difference between the data voltage and the corresponding ELVDD voltage of the pixel units in each row, wherein the voltage compensation circuit is configured to:

obtain a real-time voltage ELVDD(1) of pixel units in 1st row of the display panel; and obtain an offset between the real-time voltage ELVDD(1) and a preset data voltage.

10. The system according to claim 9, wherein the voltage compensation circuit is configured to adjust a voltage offset of a Gamma power supply based on the offset, to remain a voltage difference between the real-time voltage ELVDD(1) and a peak voltage VGMP outputted from the Gamma power supply unchanged, and remain a voltage difference between the peak voltage VGMP and a valley voltage VGSP outputted from the Gamma power supply unchanged, wherein the Gamma power supply is configured to provide a compensation voltage for each pixel unit.

* * * * *